US011633771B2

(12) United States Patent
Belanger et al.

(10) Patent No.: US 11,633,771 B2
(45) Date of Patent: Apr. 25, 2023

(54) PRESS METHODS FOR COATED STEELS AND USES OF STEELS

(71) Applicant: AUTOTECH ENGINEERING S.L., Amorebieta-Etxano (ES)

(72) Inventors: Paul Jospeh Belanger, Auburn Hills, MI (US); Ignacio Martin Gonzalez, Sant Esteve Sesrovires (ES); Manuel López Lage, Sant Esteve Sesrovires (ES)

(73) Assignee: AUTOTECH ENGINEERING S.L., Vizcaya (ES)

( * ) Notice: Subject to any disclaimer, the term of this patent is extended or adjusted under 35 U.S.C. 154(b) by 84 days.

(21) Appl. No.: 16/638,921

(22) PCT Filed: Aug. 2, 2018

(86) PCT No.: PCT/EP2018/071064
§ 371 (c)(1),
(2) Date: Feb. 13, 2020

(87) PCT Pub. No.: WO2019/025569
PCT Pub. Date: Feb. 7, 2019

(65) Prior Publication Data

US 2021/0362212 A1 Nov. 25, 2021

(30) Foreign Application Priority Data

Aug. 2, 2017 (EP) ..... 17382531

(51) Int. Cl.
*B21D 22/02* (2006.01)
*B21D 37/08* (2006.01)
(Continued)

(52) U.S. Cl.
CPC ..... *B21D 22/022* (2013.01); *B21D 37/08* (2013.01); *B21D 37/16* (2013.01); *C21D 1/673* (2013.01)

(58) Field of Classification Search
CPC .... B21D 22/022; B21D 22/208; B21D 22/20; B21D 22/02; B21D 37/08; B21D 37/16; B21D 43/05; C21D 1/673
(Continued)

(56) References Cited

U.S. PATENT DOCUMENTS

2012/0018058 A1 1/2012 Antonissen et al.
2013/0037178 A1* 2/2013 Coryell ..... C21D 1/673 148/525
(Continued)

FOREIGN PATENT DOCUMENTS

CN 1472068 A 2/2004
DE 10 2011 011 013 A1 8/2012
(Continued)

OTHER PUBLICATIONS

International Search Report for International Application No. PCT/EP2018/071064, dated Sep. 13, 2018.
(Continued)

*Primary Examiner* — Shelley M Self
*Assistant Examiner* — Teresa A Guthrie
(74) *Attorney, Agent, or Firm* — Finnegan, Henderson, Farabow, Garrett & Dunner, LLP

(57) ABSTRACT

Examples of methods of hot forming structural components are provided. The methods include heating a blank made from an Ultra High Strength Steel with an aluminum coating and forming the heated blank in a multi-step apparatus.

20 Claims, 4 Drawing Sheets

(51) Int. Cl.
*B21D 37/16* (2006.01)
*C21D 1/673* (2006.01)

(58) Field of Classification Search
USPC ..... 72/46, 404
See application file for complete search history.

(56) References Cited

U.S. PATENT DOCUMENTS

| | | | | |
|---|---|---|---|---|
| 2014/0027026 | A1* | 1/2014 | Schwinghammer | C23C 2/28 148/650 |
| 2014/0144560 | A1* | 5/2014 | Yamano | C22C 38/02 148/654 |
| 2014/0338802 | A1* | 11/2014 | Okita | C21D 1/673 148/653 |
| 2016/0263640 | A1* | 9/2016 | Martin Gonzalez | C21D 1/18 |

FOREIGN PATENT DOCUMENTS

| | | | | |
|---|---|---|---|---|
| DE | 10 2011 011013 | A1 | 8/2012 | |
| EP | 3 067 128 | A1 | 9/2016 | |
| EP | 3067128 | A1 | 9/2016 | |
| JP | 2013-123722 | A | 6/2013 | |
| JP | 2016-185565 | A | 10/2016 | |
| KR | 10-2011-0127283 | | 11/2011 | |
| WO | WO 2011/115539 | A1 | 9/2011 | |
| WO | WO-2013089167 | A1 * | 6/2013 | B21D 22/208 |
| WO | WO 2014/114420 | A1 | 7/2014 | |
| WO | WO 2017/103127 | A1 | 6/2017 | |

OTHER PUBLICATIONS

Written Opinion of the International Searching Authority for International Application No. PCT/EP2018/071064.
International Search Report received from the European Patent Office (EPO) in International Application No. PCT/EP2018/071064, dated Sep. 13, 2018 (2 pages).
Written Opinion of the International Searching Authority received from the European Patent Office (EPO) in International Application No. PCT/EP2018/071064, dated Sep. 13, 2018 (6 pages).
Office Action received in counterpart Chinese Application No. 201880049358X, dated Mar. 10, 2022 (13 pages).
Office Action received in counterpart Korean Application No. 10-2020-7002759, dated May 12, 2022 (15 pages).
Office Action received in counterpart Japanese Application No. 2020-528510, dated Jun. 7, 2022 (11 pages).

* cited by examiner

PRESS METHODS FOR COATED STEELS AND USES OF STEELS

This application is a national stage filing under 35 U.S.C. § 371 of International Application No. PCT/EP2018/071064, filed on Aug. 2, 2018, which claims priority of European Patent Application No. 17382531.6 filed on Aug. 2, 2017. The contents of these applications are each incorporated herein by reference.

The present disclosure relates to methods for manufacturing hot formed structural components and uses of ultra high strength steels in hot forming processes.

BACKGROUND

In the field of vehicle construction, the development and implementation of lightweight materials or components is becoming more and more important in order to satisfy criteria for lightweight construction. The demand for weight reduction is especially driven by the goal of reduction of $CO_2$ emissions. The growing concern for occupant safety also leads to the adoption of materials which improve the integrity of the vehicle during a crash while also improving the energy absorption.

A process known as Hot Forming Die Quenching (HFDQ) (also known as hot stamping or press hardening) uses e.g. boron steel sheets to create stamped components with Ultra High Strength Steel (UHSS) properties, with tensile strengths of e.g. 1.500 MPa or even up to 2.000 MPa or more. The increase in strength as compared to other material allows for a thinner gauge material to be used, which results in weight savings over conventionally cold stamped mild steel components.

In order to improve corrosion protection before, during or after a hot stamping process, coatings may be applied. For example the use of Al—Si coatings or Zn coatings is known.

Depending on the composition of the base steel material, blanks may need to be quenched (i.e. be cooled down rapidly) to achieve the high tensile strengths. Examples of steel material which can harden by leaving them to cool to room temperature by air cooling with relatively low cooling speed are also known. These steels may be referred to as "air hardenable" steels.

The hot stamping process may be performed in a manner such that a blank to be hot formed is heated to a predetermined temperature e.g. to or above an austenization temperature by, for example, a furnace system so as to decrease the strength of the blank i.e. to facilitate the hot stamping process. The heated blank may be formed by, for example, a press system having a low temperature compared to the blank (e.g. room temperature) and a temperature control, thus a shaping process and a heat treatment using the temperature difference may be performed.

A hot stamping process may include a conveyor or a transferring device which transfers the heated blank from the furnace to a press tool which is configured to press the blank. Upstream from the furnace system, a cutting system for cutting blanks directly from a steel coil can be provided.

The use of multistep press apparatus for manufacturing hot formed elements is known. The multistep press apparatus may comprise a plurality of tools configured to perform different operations on different blanks simultaneously. With such arrangements, a plurality of blanks can undergo different manufacturing steps simultaneously during each stroke of the press apparatus. The efficiency and performance of a multistep apparatus may be higher than systems employing a plurality of different machines or apparatuses for different manufacturing steps, such as, laser trimming or hard cutting.

When zinc coated steel blanks are used, the blanks need to be cooled down to a certain temperature before a hot forming process to reduce or minimize problems such as microcracks. Once the blank is cooled down, it is transferred from the external pre-cooling tool to the multistep press apparatus.

EP3067129 A1 discloses press systems for manufacturing hot formed structural components. The system comprises a fixed lower body, a mobile upper body and a mechanism configured to provide upwards and downwards press progression of the mobile upper body with respect to the fixed lower body. The system further comprises a cooling/heating tool configured to cool down and/or heat a previously heated blank having locally different microstructures and mechanical properties which comprises: upper and lower mating dies, and the upper and lower dies comprising two or more die blocks adapted to operate at different temperatures corresponding to zones of the blank having locally different microstructures and mechanical properties, and a press tool configured to draw the blank, wherein the press tool is arranged downstream the cooling/heating tool. This system is particularly aimed at creating "soft zones" in order to improve the ductility and energy absorption in specific areas of a component made from Usibor® (22MnB5). This use of 22MnB5 boron steel requires a specific temperature control between different die blocks of the cooling/heating tool and downstream post-processing tools to achieve the different microstructures and corresponding different characteristics.

EP3067128 A1 discloses a multistep press system for manufacturing hot formed structural components. The system comprises a fixed lower body, a mobile upper body and a mechanism configured to provide upwards and downwards press progression of the mobile upper body with respect to the fixed lower body. The system further comprises a cooling tool configured to cool down a previously heated blank which comprises: upper and lower mating dies, the lower die connected to the lower body with one or more lower biasing elements and/or the upper die connected to the upper body with one or more upper biasing elements. The system further comprises a press tool configured to draw the blank, wherein the press tool is arranged downstream from the cooling tool. This system is particularly aimed at the use of zinc coated ultra high strength steels.

One disadvantage related to the use of zinc coated steels is that a zinc oxide layer can form on the blanks. In many applications, the zinc oxide layer needs to be removed or reduced after the manufacturing process. For example shot blasting may be used to remove the zinc oxide layer partially or completely. Also, components with an AlSi coated can generally be welded better than components with a Zn coating.

The present disclosure seeks to provide improvements in multistep processes and apparatuses.

SUMMARY

In a first aspect, a method for hot forming a structural component system in a multi-step apparatus is provided. The multi-step apparatus comprises a lower body, a mobile upper body, a mechanism configured to provide upwards and downwards press progression of the mobile upper body with respect to the lower body, and a press tool configured to draw the blank. The press tool comprises upper and lower mating pressing dies, each pressing die comprising one or more working surfaces that in use face the blank, and the upper pressing die is connected to the upper body and the lower pressing die is connected to the lower body. The multi-step apparatus further comprising an additional tool including upper and lower dies comprising one or more working surfaces that in use face the blank, and the lower die of the additional tool is connected to the lower body and the upper die of the additional tool is connected to the upper body. The method comprises providing a blank made of an Ultra High Strength Steel (UHSS) coated with an aluminium-silicon coating, heating the blank to above an austenization temperature, and drawing the heated blank in the press tool and transferring the blank between the press tool and the additional tool.

According to this aspect, an UHSS steel blank with an aluminium silicon coating is used so that shot blasting to remove the zinc oxide layer partially or completely is not necessary. The use of a multistep apparatus can improve throughput.

With the integration of the tools in the same apparatus by connecting the upper dies of the press tool and the additional tool to the mobile upper body, the transfer time from between the press tool and the additional tool(s) may be reduced, thus the process may be optimized and the productivity may be improved. Also the temperature of the blanks during the different steps of the process can be improved.

In some examples, the additional tool is a cooling tool arranged upstream from the forming tool, and the method comprising cooling down the complete heated blank.

In some examples, the dies of the cooling tool may comprise channels conducting cooling water. The dies of the cooling tool may alternatively or additionally comprise channels conducting air.

In some examples, the austenization temperature to which a blank may be heated may be an Ac3 temperature, and cooling down the complete heated blank comprises cooling down the blank to a temperature between 600-800° C., specifically between 650°-700° C.

In some examples, the blank may be cooled down at a rate between 50 and 300° C./s.

In some examples, a temperature of the blank in the forming tool before drawing may be in a range of 550-650° C.

In some examples, the additional tool is a heating tool arranged upstream from the forming tool, and heating the blank above the austenization temperature comprises heating the blank in a furnace to a first temperature, and heating the blank from the first temperature to a second temperature in the heating tool.

In some examples, the blanks may be made from an UHSS comprising in weight percentages 0.15-0.25% C, maximum 0.5% Si, maximum 2.5% Mn, 0.002-0.005% B and maximum 0.05% Cr. In some examples, the UHSS may further comprise Al, Ti, P, and Mo.

In some examples, the blanks may be made from an UHSS comprising in weight percentages 0.15-0.25% C, maximum 1% Si, maximum 2.5% Mn, 0.002-0.005% B and 0.5-0.7% Cr.

In an alternative example, the UHSS material comprises in weight percentages 0.15-0.25% C, maximum 0.5% Si, maximum 2.5% Mn, 0.002-0.005% B and maximum 0.5% Cr, preferably about 0.3% Cr. In some examples, the UHSS may further comprise Al, Ti, P, and Mo.

In some examples, the multi-step apparatus may further comprise a first post operation tool downstream from the press tool, the first post operation tool comprising upper and lower first post operation dies comprising one or more working surfaces that in use face the blank, and the lower first post operation die being connected to the lower body and the upper first post operation die being connected to the upper body.

In some examples, the first post operation tool may comprise a temperature control system for controlling the temperature of the blank during the first post operation, the temperature control system optionally including thermocouples in the upper and lower first post operation dies.

In some examples, the dies of the first post-operation tool may comprise channels conducting cooling water or cooling air.

In some examples, the dies of the first post-operational tool may comprise one or more heaters or channels conducting a hot liquid or conductive heating.

In some examples, the multi-step apparatus may further comprise a second post operation tool downstream from the first post operation tool, the second post operation tool comprising upper and lower second post operation dies comprising one or more working surfaces that in use face the blank, and the lower second post operation die being connected to the lower body and the upper second post operation die being connected to the upper body.

In some examples, the second post operation tool may comprise a temperature control system for controlling the temperature of the blank during the second post operation, the temperature control system optionally including thermocouples in the dies.

In some examples, the dies of the second post-operation tool may comprise channels conducting cooling water or cooling air, and/or one or more heaters or channels conducting a hot liquid.

By integrating multiple tools including post-operation tools in the multistep apparatus, no separate laser cutting system and process is required.

In some examples, the dies of the press tool may comprise channels conducting cooling water and/or channels conducting air.

In some examples, the blank may be heated to an austenization temperature between 860° C. and 910° C.

In some examples, the method may furthermore comprise cooling down the blank during forming. Optionally, the blank may be cooled down during forming to a temperature between 450 to 250° C., preferably between 320° C. and 280° C.

In some examples, the temperature of the blank when leaving the multi-step apparatus may be below 200° C.

In a second aspect, a use of an Ultra High Strength Steel (UHSS) having an aluminium-silicon coating in a hot forming process is provided. The hot forming process includes heating a blank made of the UHSS having an aluminium silicon coating to above an austenization temperature, and forming the heated blank in a multi-step apparatus, the multi-step apparatus comprising a cooling tool and a forming tool integrated in the multi-step apparatus, the cooling tool arranged upstream from the forming tool.

By integrating a cooling step prior to a forming step, the cycle time of the forming step may be reduced. Other steps integrated in the multistep apparatus, such as cutting operations, can then be synchronized with the forming step and the cycle time can correspondingly be reduced.

The multi-step apparatus might in some examples only combine a cooling tool and a forming tool, the cooling tool being arranged upstream from the forming tool. An advantage of integrating a pre-cooling in the apparatus in this case can be that even with reduced cycle time, a sufficiently low temperature may be reached for the resulting blank/product at the end of the forming. Deformation that might be caused such as warping can then be avoided.

In a further aspect, a use of an Ultra High Strength Steel (UHSS) having an aluminum-silicon coating in a hot forming process is provided. The hot forming process includes heating a blank made of the UHSS having an aluminum silicon coating to above an austenization temperature, and forming the heated blank in a multi-step apparatus including multiple tools integrated in the multi-step apparatus, wherein the UHSS comprises in weight percentages 0.20-0.25% C, 0.75-1.5% Si and 1.50-2.50% Mn. Preferably, the UHSS comprises in weight percentages 0.21-0.25% C, 1.05-1.33% Si, 2.06-2.34% Mn.

Such an UHSS does not require significant cooling during the forming step in order to achieve a martensitic microstructure with ultra high strength characteristics. Instead, such an UHSS at least in some cases can be hardened simply by ambient air. The cycle time of the multistep processes may thus be shortened when no extensive cooling in the cooling tool is required. The output of the process can thus be increased accordingly.

In some examples, the UHSS may comprise approximately 0.22% C, 1.2% Si, 2.2% Mn in weight percentages.

In some examples, the UHSS may further comprise Mn, Al, Ti, B, P, S, N. The rest being made up from iron (and impurities).

In yet a further aspect, a use of an Ultra High Strength Steel (UHSS) having an aluminium-silicon coating in a hot forming process is provided. The hot forming process includes heating a blank made of the UHSS having an aluminium silicon coating to above an austenization temperature, and forming the heated blank in a multi-step apparatus, wherein the UHSS is an air hardenable steel.

In some examples, the UHSS may be a non air hardenable steel. Non air hardenable steels need to be cooled down rapidly for transforming the austenite into martensite. These steels cannot completely harden by leaving them to cool to room temperature by unforced air cooling. Cooling rates higher than air cooling rates may be required to transform the austenite into martensite. For example, non air hardenable steels may require critical cooling rates higher than 25° C./s to completely transform the austenite into martensite. The critical cooling rate is herein to be understood as the slowest cooling rate at which fully martensitic structure is formed.

In some examples, the non air-hardenable steel may be a 22MnB5 steel. Usibor® 1500P is an example of a 22MnB5 steel. The composition of Usibor® is summarized below in weight percentages (rest is iron (Fe) and unavoidable impurities):

| C | Si | Mn | P | S | Cr | Ti | B | N |
|---|---|---|---|---|---|---|---|---|
| 0.24 | 0.27 | 1.14 | 0.015 | 0.001 | 0.17 | 0.036 | 0.003 | 0.004 |

After a hot stamping die quenching process, Usibor® 1500P may have a yield strength of e.g. 1.100 MPa, and an ultimate tensile strength of 1.500 MPa.

Usibor® 2000 is another boron steel with even higher strength. After a hot stamping die quenching process, the yield strength of Usibor® 2000 may be 1.400 M Pa or more, and the ultimate tensile strength may be above 1.800 MPa. A composition of Usibor® 2000 includes a maximum of 0.37% of carbon, a maximum of manganese of 1.4%, a maximum of 0.7% of silicon and a maximum of 0.005% of boron by weight.

In yet a further aspect, the hot forming process includes heating a blank made of the UHSS having an aluminium silicon coating to above an austenization temperature, and forming the heated blank in a multi-step apparatus, wherein the UHSS is a non air hardenable steel. The blank may be cooled down at a cooling rate that is not sufficient to completely transform the total amount of austenite into martensite, i.e. the cooling rate may be, at least during some part of the process, lower than the critical cooling rate of the steel. The result of using a non air hardenable steel may be that the microstructure of the steel at the end of the forming process would not be completely martensitic, thus having a higher percentage of bainite. Accordingly, the strength, e.g tensile and/or yield strength, achieved by the hot-formed blank by using this process may be lower than if the hot-formed blank were completely hardened. Although the strength of these products may be slightly lower than in processes wherein the cooling down rate is higher than the critical cooling rate, the time of cycle of these products may be reduced, and still components with desired strength and stiffness requirements can be obtained.

In yet a further aspect, a method for hot forming a structural component is provided. The method comprises providing a blank made of an Ultra High Strength Steel (UHSS) coated with an aluminium-silicon coating, heating the blank to above an austenization temperature, cooling down the blank in a cooling tool, transferring the blank from the cooling tool to a press tool and drawing the blank in the press tool. Herein, the cooling tool and the press tool are integrated in a multi-step apparatus.

In some examples, when the UHSS is a non air hardenable steel, after hot forming in a multi-step apparatus, the yield strength of the non air hardenable steel may be in the range 500-1600 MPa and its ultimate tensile strength may be in the range 1000-2000 MPa. In some other examples, after hot forming in a multi-step apparatus, the yield strength of the non air hardenable steel may be in the range 700-1400 MPa and its ultimate tensile strength may be in the range 1200-1800 MPa. In an advantageous example, after hot forming in a multi-step apparatus, the yield strength of the non air hardenable steel may be in the range 900-1100 MPa and its ultimate tensile strength may be in the range 1400-1600 MPa.

In some examples, the non air hardenable UHSS may comprise in weight percentages 0.20-0.50% C, preferably 0.30-0.40% C, 0.10-0.70% Si, 0.65-1.60% Mn and 0.001-0.005% B. In addition, the non air hardenable UHSS may comprise a maximum of 0.025% P, a maximum of 0.01% S, a maximum of 0.80% Cr, more preferably a maximum of 0.35% Cr, and a maximum of 0.040% Ti.

In yet a further aspect, a component obtainable by any of the methods or uses herein disclosed is provided.

BRIEF DESCRIPTION OF THE DRAWINGS

Non-limiting examples of the present disclosure will be described in the following, with reference to the appended drawings, in which.

DETAILED DESCRIPTION OF EXAMPLES

Figure 1:
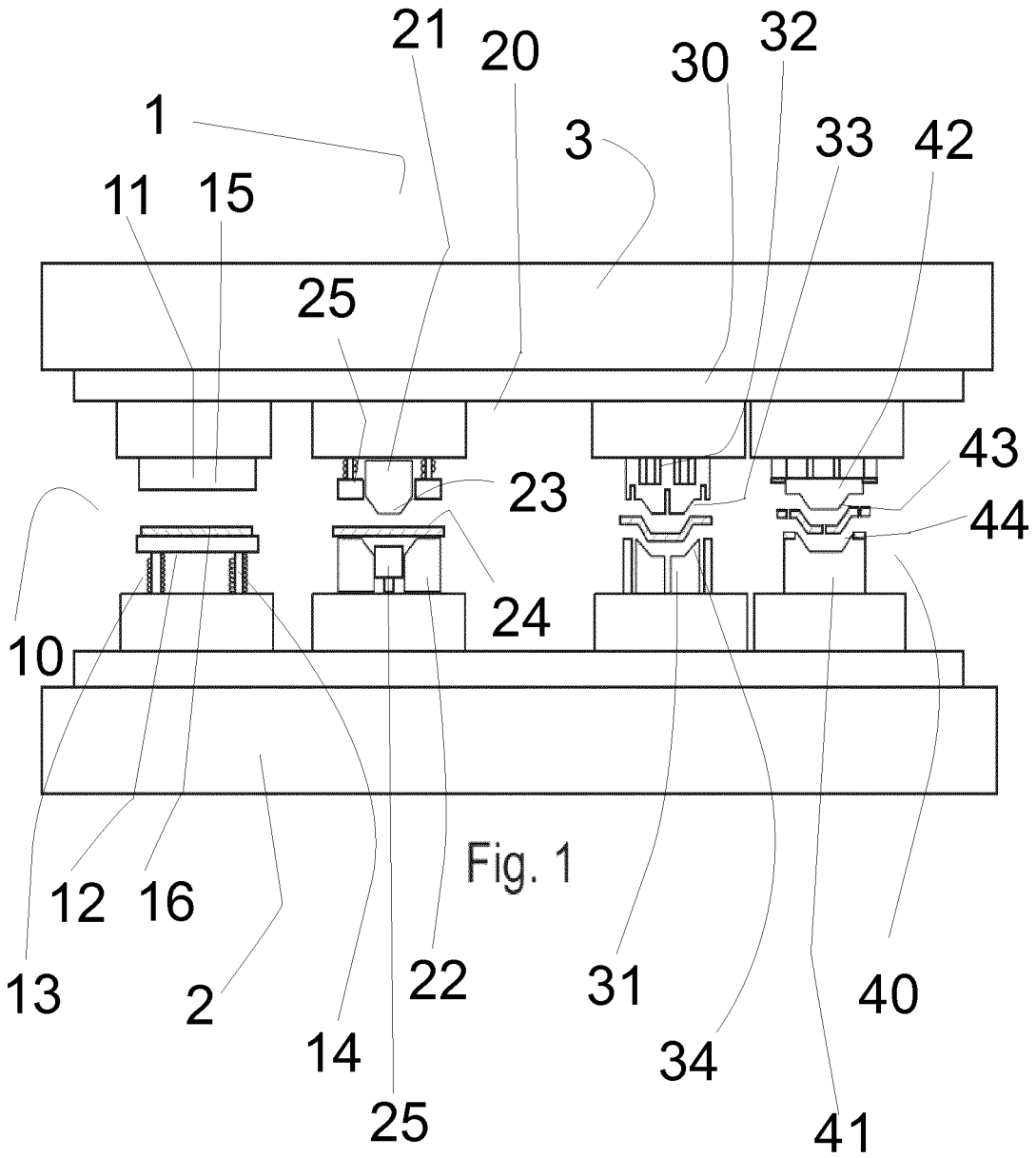
FIG. 1 schematically represents a multistep press system according to an example.

FIG. 1 schematically represents a multistep press system according to an example. The system 1 comprises a fixed lower body 2, a mobile upper body 3 and a mechanism (not shown) configured to provide upwards and downwards press progression of the mobile upper body 3 with respect to the fixed lower body 2.

The fixed lower body 2 may be a large block of metal. In this particular example, the fixed lower body 2 may be stationary. In some examples, a die cushion (not shown) integrated in fixed lower body 2 may be provided. The cushion may be configured to receive and control blank holder forces. The mobile upper body 3 may also be a solid piece of metal. The mobile upper body 3 may provide the stroke cycle (up and down movement).

The press system may be configured to perform e.g. approximately 30 strokes per minute, thus each stroke cycle may be of approximately 2 seconds. The stroke cycle could be different in further examples. In a multistep press system all operations to be formed on a blank need to have the same cycle time.

The mechanism of the press may be driven mechanically, hydraulically or servo mechanically. The progression of the mobile upper body 3 with respect to the fixed lower body 2 may be determined by the mechanism. In this particular example, the press may be a servo mechanical press, thus a constant press force during the stroke may be provided. The servo mechanical press may be provided with infinite slide (ram) speed and position control. The servo mechanical press may also be provided with a good range of availability of press forces at any slide position, thus a great flexibility of the press may be achieved. Servo drive presses have capabilities to improve process conditions and productivity in metal forming. The press may have a press force of e.g. 2000 Tn.

In some examples, the press may be a mechanical press, thus the press force progression towards the fixed lower body 2 may depend on the drive and hinge system. Mechanical presses therefore can reach higher cycles per unit of time. Alternatively, hydraulic presses may also be used.

A cooling tool 10 configured to cool down a previously heated blank is shown in the example FIG. 1. The cooling tool 10 may comprise upper 11 and lower 12 mating dies. Each die comprises an upper working surface 15 and a lower working surface 16 that in use face a blank (not shown) to be hot formed.

In this example, the lower die 12 is connected to the lower body 2 with a first lower biasing element 13 and a second lower biasing element 14 configured to bias the lower die 12 to a position at a predetermined first distance from the lower body 2. In some examples, a single lower biasing element may be provided, or more than two lower biasing elements can be provided. The biasing elements may comprise, for example, a spring e.g. a mechanical spring or a gas spring although some other biasing elements may be possible e.g. hydraulic mechanism.

In some other examples, the upper die 11 may also be connected to the upper body 3 with one or more upper biasing elements configured to bias the upper die in a position at a predetermined second distance from the upper body.

With the insertion of the upper and/or lower biasing elements, the contact time between the upper die 11 and the lower die 12 may be regulated and increased during a stroke cycle (up and down movement of the mobile upper body 3 with respect to the lower body 2).

Due to the biasing elements in the cooling tool, the contact between the upper and lower cooling dies may be produced before the contact of the press dies of the forming tool (and further tools arranged downstream). Thus, contact time between the cooling dies during a stroke cycle may be increased or shortened allowing for more or less cooling.

The use of such biasing elements allows the cooling tool to have a different cycle time than the other tools integrated in the same apparatus. This is explained in more detail in EP3067128. However, within the scope of the present disclosure, the use of biasing elements is merely optional. Depending on the steel of the blanks and their coating, biasing elements may not be needed at all.

The upper 11 and lower 12 mating dies may comprise channels (not shown) with cold fluid e.g. water and/or cold compressed air passing through the channels provided in the dies.

Additionally, the cooling tool 10 may comprise one or more electrical heaters or channels conducting a hot liquid and temperature sensors to control the temperature of the dies. Other alternatives for adapting the dies to operate at higher temperatures may also be foreseen, e.g. embedded cartridge heaters. This may allow working with blanks of different thicknesses i.e. very thin blanks which may be cooled down too fast, thus the flexibility of the cooling tool may be improved. The sensors may be thermocouples.

Furthermore, the upper 11 and/or lower 12 mating dies may be provided with a cooling plate (not shown) which may be located at the surfaces opposite to the upper working surface 15 and/or the lower working surface 16 comprising a cooling system arranged in correspondence with each die respectively. The cooling system may comprise cooling channels for circulation of cold water or any other cooling fluid in order in order to avoid or at least reduce heating of the cooling tool or to provide an extra cooling to the cooling tool.

In examples, the cooling tool may be provided with centering elements e.g. pins and/or guiding devices.

A press tool 20 configured to form or draw the blank is also integrated in the same press apparatus. The press tool 20 is arranged downstream from the cooling tool 10. The press tool 20 comprises upper 21 and lower 22 mating dies.

The upper die 21 may comprise an upper working surface 23 that in use faces the blank to be hot formed. The lower die 22 may comprise a lower working surface 24 that in use faces the blank to be hot formed. A side of the upper die opposite to the upper working surface 23 may be fastened to the upper body 3 and a side of the lower die opposite to the lower working surface 22 may be fastened to the lower body 2.

The upper 21 and lower 22 mating dies may comprise channels with cold fluid e.g. water and/or cold air passing through the channels provided in the dies. In the water channels, the speed circulation of the water at the channels may be high, thus the water evaporation may be avoided. A control system may be further provided that may control fluid temperature and flow rate based on temperature measurements, thus the temperature of the dies may be controlled.

In examples, the press system 20 may be provided with a blank holder 25 configured to hold a blank and to position the blank onto the lower die 22. The blank holder may also be provided with e.g. springs to bias the blank holder to a position at a predetermined distance from the lower die 22.

In this example, a first post-operation tool 30 configured to perform trimming and/or piercing operations is provided in the same multi-press apparatus. It should be clear that in other examples, no post-operation tool might be integrated in the multi-press apparatus.

The first post-operation tool 30 is arranged downstream of the press tool 20. The first post operation tool 30 comprises upper 32 and lower 31 mating dies. The upper mating die 32 may comprise an upper working surface 33 and the lower mating die 31 may comprise a lower working surface 34. Both working surfaces in use face the blank.

A side of the upper die 32 opposite to the upper working surface 33 may be fastened to the upper body 3 and a side of the lower die 31 opposite to the lower working surface 34 may be fastened to the lower body 2. The dies may comprise one or more knives or cutting blades (not shown) arranged on the working surfaces.

The first post operation tool 30 may further also comprise one or more electrical heaters or channels conducting hot liquid and temperature sensors to control the temperature of the dies. The sensors may be thermocouples. In some examples, it is preferable to maintain the temperature of the blank located between the upper and lower dies when in use at or near a predetermined temperature e.g. above 200° C. The desirable temperature can depend on the steel used. In general, a minimum temperature may be determined above which the post operation can still be performed without damaging the tools.

In some examples, the upper 32 and lower 31 mating dies may comprise channels with cold fluid e.g. water and/or cold air passing through the channels provided in the dies.

In examples, the first post operation tool 30 may be provided with a blank holder (not shown) configured to hold a blank and to position the blank onto the lower die 31. The blank holder may also be provided with one or more biasing elements configured to bias the blank holder to a position at a predetermined distance from the lower die.

In this example, a second post-operation tool 40 may be provided. The second post-operation tool 40 may be configured to perform further trimming and/or piercing operations. In this example, the second post-operation tool is also configured for calibration of the blanks. The second post-operation tool 40 is arranged downstream from the first post operation tool 30. The second post-operation tool 40 comprises upper 42 and lower 41 dies. The upper die 42 may comprise an upper working surface 43 and the lower die 41 may comprise a lower working surface 44. Both working surfaces in use may face the blank to be hot formed. The working surfaces may be uneven, e.g. they may comprise protruding portions or recesses.

The dies at the press tool 40 may have a different temperature than the blank to be hot formed, thus the thermal expansion may be taken into account. For example, the dies may be 2% longer and/or wider than the blank to be hot formed in order to balance.

A side of the upper die 42 opposite to the working surface 43 may be fastened to the upper body 3. A side of the lower die 41 opposite to the working surface 44 is fastened to the lower body 2.

The dies may comprise one or more knives or cutting blades arranged on the working surfaces.

In some examples, an adjusting device (not shown) configured to adjust the distance between the upper 42 and lower 41 dies may be provided. This way, the blank located between the upper 42 and lower 41 dies when in use may be deformed along the working surfaces of each upper and lower die.

Once the adjustment of the distance between the upper 42 and lower dies 41 in order to deform (and thus calibrate the blank) is performed, the tolerances of the hot formed blank may be improved. In some examples, the blank to be hot formed may have an area with a non-optimized thickness e.g. greater thickness in one part of the blank than in some other part, thus the thickness has to be optimized.

With this arrangement of uneven working surfaces, the distance at selected portions of the working surfaces (e.g. near a radius in the blank) may be adjusted at or near the area with a non-optimized thickness, thus the material may be deformed i.e. forced to flow to zones adjacent to the area with a non-optimized thickness, thus a constant thickness along the blank may be achieved.

In examples, the adjusting device may be controlled based on a sensor system configured to detect the thickness of the blank.

In some examples, the second post-operation tool 40 may be provided with a blank holder (not shown) configured to hold a blank and to positioning the blank onto the lower die 41.

In further examples, other ways of adapting the dies of the tools to operate at lower or higher temperatures may also be foreseen.

It should be understood that although the figures describe dies having a substantially square or rectangular shape, the blocks may have any other shape and may even have partially rounded shapes.

An automatic transfer device (not shown) e.g. a plurality of industrial robots or a conveyor may also be provided to perform the transfer of blanks between the tools.

In all examples, temperature sensors and control systems in order to control the temperature may be provided in any tools or in the transfer system. The tools may also be provided with further cooling systems, blanks holders, etc.

FIGS. 2*a*-2*i* schematically illustrate a sequence of steps occurring during the performance of an example of a multi-step process based on the multi-step apparatus previously illustrated in FIG. 1.

Figure 2A:
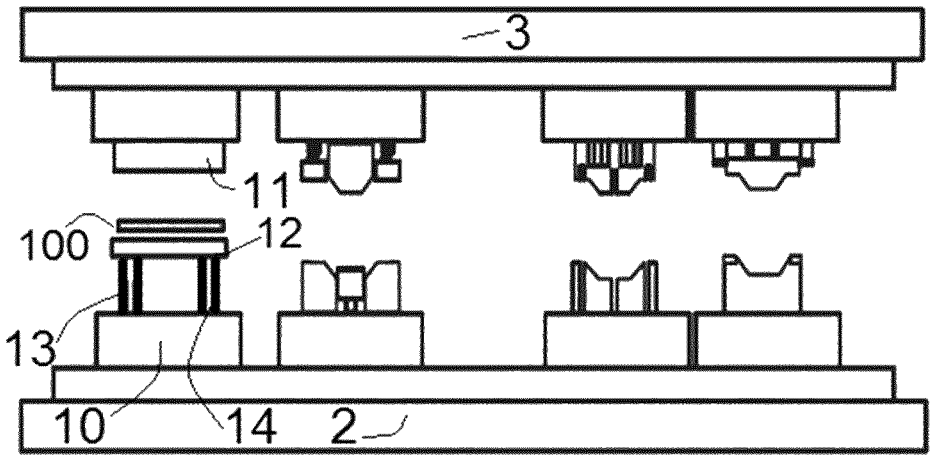
FIGS. 2*a*-2*i* schematically illustrate a sequence of situations occurring during the performance of an example of a multi-step process.

For the sake of simplicity, references to angles have occasionally been included in descriptions relating to FIG. 2*a* (and further figures). The references to angles may 5 be used to indicate approximate positions of the upper body with respect to the lower body. Thus, for example, reference may be made to that the upper body is at 0° position with respect to the lower body which indicates that the upper body is in the highest position with respect to the lower body and 180° to indicate that the upper body is in the lowest position (full contact position) with respect to the lower body. 360° then refers again to the upper body being in the highest position.

In FIG. 2*a*, a blank 100 to be hot formed made of an Ultra High Strength Steel (UHSS) having a AlSi (aluminium-silicon) coating may be provided. The AlSi coating protects against corrosion in particular during heating of the blank. In some examples, an air hardenable steel may be used. In some examples, the UHSS may contain 0.20-0.25% C; 0.75-1.5% Si and 1.50-2.50% Mn. The percentages are expressed by weight.

In a preferred embodiment, the UHSS may contain 0.21-0.25% C; 1.05-1.33% Si and 2.06-2.34% Mn. More preferably, the UHSS may contain e.g. approximately 0.22% C, 1.2% Si, 2.2% Mn. The amount of Si and Mn may enable hardening the blank with air at room temperature, thus quenching may be avoided (and thus the blank manufacturing press time may be reduced). Moreover, the press stroke cycle may also be reduced since the dies of the extra cooling down for quenching stage do not remain closed during the cooling. The material may further comprise Mn, Al, Ti, B, P, S, N in different proportions.

Different steel compositions may be used. Particularly the steel compositions described in EP 2 735 620 A1 may be considered suitable. Specific reference may be had to table 1 and paragraphs 0016-0021 of EP 2 735 620, and to the considerations of paragraphs 0067-0079. Alternatively, non air hardenable steels may be used.

Ultra High Strength Steel (UHSS) may have an Ac3 transformation point (austenite transformation point, hereinafter, referred to as "Ac3 point") between 850 and 900° C., e.g. for the above mentioned steel composition Ac3 may be in a range of 860° C. The Ms transformation point (martensite start temperature, hereinafter, referred to as "Ms point") may be between 380 and 390° C. For the above mentioned steel composition, Ms may be approximately 386° C. The Mf transformation point (martensite finish temperature, hereinafter, referred to as "Mf point") may be at or near 270° C.

The blank 100 may be heated in order to reach at least the austenization temperature. The heating may be performed in a heating device (not shown) e.g. a furnace. The maximum temperature to reach may be determined by the coating, in order to make sure the coating does not evaporate. Thus, the heating may be performed between Ac3 and a maximum permissible temperature. The period of time for heated may be a few minutes, but it is dependent on e.g. the blank's thickness.

Once the blank 100 is heated to the desired temperature, the blank 100 may be transferred to the cooling tool 10. This may be performed by an automatic transfer device (not shown) e.g. a plurality of industrial robots or a conveyor. The period of time to transfer the blank between the furnace (not shown) and the cooling tool 10 may be between 2 and 3 seconds.

In some examples, a centering element e.g. pins and/or guiding devices may be provided upstream the cooling tool, thus the blank may be properly centered.

The press upper body 3 may be located at an open position (0° position) using the press mechanism. The blank 100 may be placed between the upper die 11 and the lower die 12. In some examples, the blank may be placed on a blank holder. The lower die 12 may be displaced at a predetermined distance with respect the lower body 2 using a first lower biasing element 13 and a second lower biasing element 14.

As commented above, the biasing elements may comprise, for example, a spring e.g. a mechanical spring or a gas spring although some other biasing elements may be possible e.g. hydraulic mechanism. The hydraulic mechanism may be a passive or an active mechanism This way, the lower die 12 (and thus the blank 100 located on the lower die 12) may be situated at a first predetermined position (a position where the lower die may be contacted between 90° and 150° by the upper die) from the lower body 2.

Figure 2B:
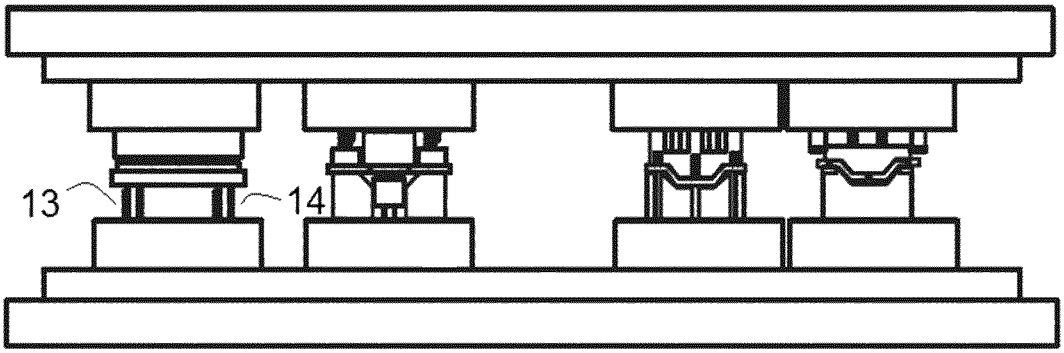

In FIG. 2*b*, the situation is shown in which the press has performed downwards press progression of the mobile upper body with respect to the fixed lower body, thus the upper die 11 has been be moved towards the lower die 12 (and thus the blank located on the lower die). The dies of the cooling tool bear down on the blank and thereby cool the blank.

Once the final desired position (180° position) is reached, an upwards press progression of the upper body by the press mechanism may be provided. The first lower biasing element 13 and the second lower biasing element 14 may return to their original position i.e. be extended.

It has already been commented that the blank 100 may be previously heated to e.g. 870-910° C. The blank may be transferred to the cooling tool 10, thus during the transfer period the temperature may be reduced to between 750° C. and 850° C. With this arrangement, the blank 100 may be placed at the cooling tool 10 at a temperature of between 750° C. and 850° C. The blank in this example may then be cooled in the cooling tool down to a temperature between 650° and 700° C. Part of the cooling necessary in order to obtain martensitic microstructure may thus already be performed in the cooling tool, rather than in during the actual drawing of the blank. Consequently, the next step in the process i.e. drawing can in some cases be shortened, leading to shorter cycle times and increased output.

With the cooling tool 10 integrated in the multi-press apparatus 1, the time in order to cool down the blank may be optimized since an extra movement in order to transfer the blank from an external cooling tool may be avoided. It also may be time saving. Furthermore, the movements of the blank between the tools may be limited, thus the cooling rates are easily controlled.

Figure 2C:
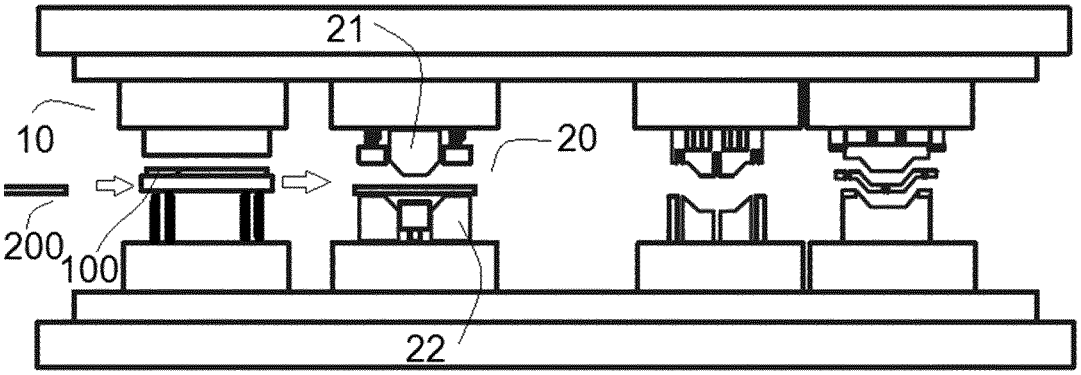

In FIG. 2*c*, the blank 100 has already undergone a cooling process, thus the blank 100 may be ready to be transferred from the cooling tool 10 to the press tool 20. The transferring may be performed by an automatic transfer device (not shown) e.g. a plurality of industrial robots or a conveyor. As commented above, the blank may be transferred at a temperature at or near 650-700° C. Due to the transfer time, the blank 100 may be cooled down to between 550° C. and 650° C. before drawing starts. The blank 100 may be positioned by the transfer device onto the lower die 22 using a blank holder.

Since the transfer device is integrated in the same press system, there is less transfer time, and the temperature control is better.

While the blank 100 is being transferred or positioned onto the lower die 22, the automatic transfer system may be operated to provide a blank 200 to the cooling tool 10. As a result, the cooling tool 10 may start the operation in order to cool down the blank. This operation may be performed as stated before. Furthermore, this operation may be performed at the same time as the operation of the press tool 20.

This way, the press upper body 3 may be located again at an open position (0° position) using the press mechanism. The blank 100 may be placed between the press tool upper die 21 and the press tool lower die 22.

Figure 2D:
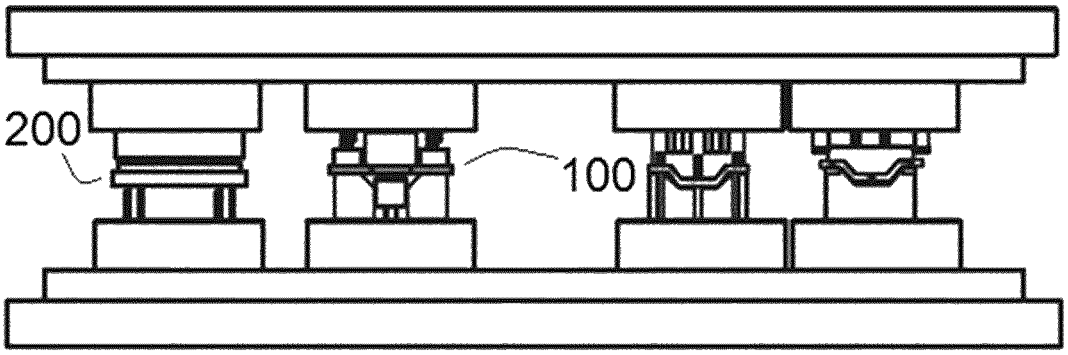

In FIG. 2*d*, a downwards press progression has been completed, drawing of blank 100 is underway, as well as cooling of blank 200. An upwards press progression may be provided. The last complete contact between the working surface of the upper die of the forming tool and the blank (and thus the end of the drawing operation) may be e.g. between 180° and 210° position.

The temperature of the blank 100 may be reduced until e.g. a temperature below Ms or below Mf is reached, depending on the type of steel used. E.g. for the UHSS compositions disclosed in EP 2 735 620, a suitable temperature may be around 300° C. The press tool may be provided with a cooling system. The cooling system may be controlled by a controller, thus the temperature of the blank 100 may be reduced and maintained at a desired temperature.

Figure 2E:
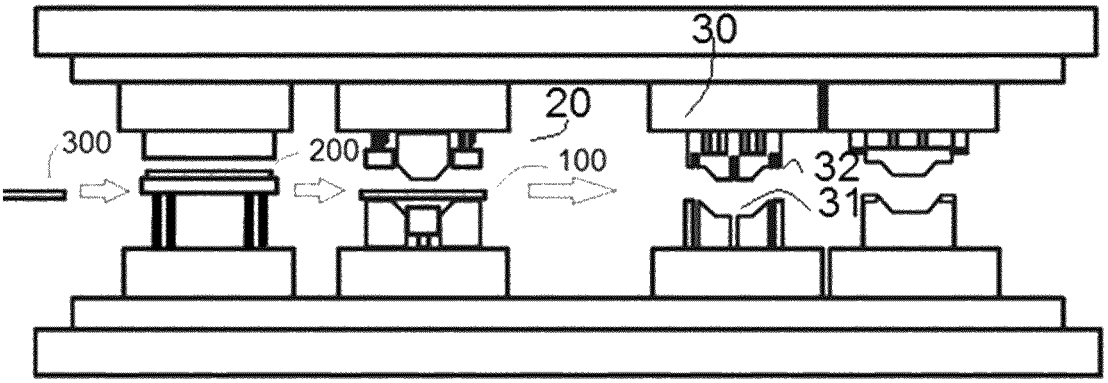

In FIG. 2*e*, the blank 100 also already has been drawn, and thus the blank 100 is ready to be transferred from the press tool 20 to the first post operation tool 30 e.g. a piercing or trimming operations tool. The transferring may be performed by an automatic transfer device (not shown) e.g. a plurality of industrial robots or a conveyor. As commented above, the blank 100 may leave the press tool 20 and it may be transferred at a temperature at or near 300° C. Due to the transfer time, the blank 100 may be cooled down at or near 280° C., and thus be placed at the first post operation tool at this temperature. The blank 100 may be placed onto the lower die 31 and between the lower die 31 and the upper die 32.

In FIG. 2*e*, when the blank 100 has been transferred or positioned onto the lower die 31, the automatic transfer system may be operated to position the blank 200 in the press tool 20 and to position a blank 300 in the cooling tool 10. As a result, the cooling tool 10 may start the operation in order to press and cool down the blank 300 as commented above. At the same time, the press tool 20 may start the operation in order to draw and cool down the blank 300 as also commented above.

This way, the press upper body 32 may be located at an open position (0° position) using the press mechanism. The press 1 may be provided with a downwards press progression of the mobile upper body 3 with respect to the fixed lower body 2, thus the upper die 32 may be moved towards the lower die 31.

Figure 2F:
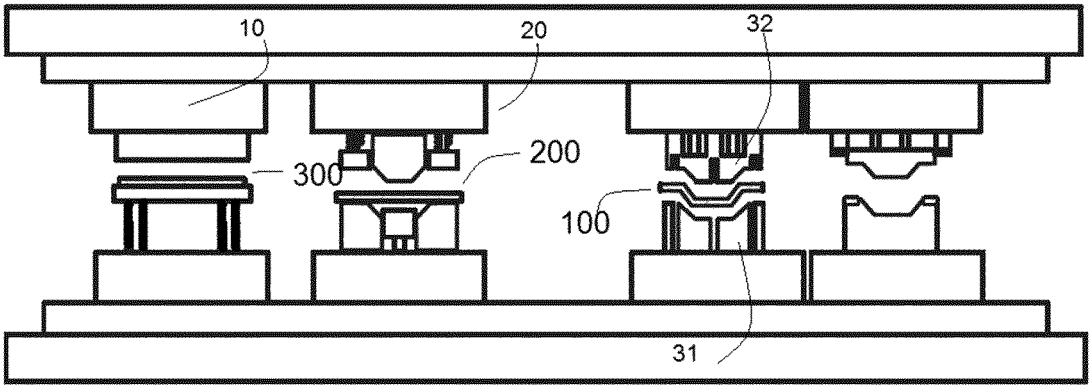

In FIG. 2*f*, the upper die 32 may contact the blank 100 placed between the press tool upper die 31 and the press tool lower die 31 during the downwards press progression.

While the press is in contact with the blank 100, a piercing operation may be performed using the cutting blades or some other cutting element. Once the piercing operation is finished, a trimming operation may be performed. In alternative examples, the trimming operation may be performed first and the piercing operation may be performed once the trimming operation is finished.

While the blank 100 undergoes the post operation, the blank may be heated up by using the heating equipment commented above. In order not to damage the tools, the steel cannot be too hard, and therefore a minimum temperature may have to be respected.

After reaching the 180° position, an upwards press progression may be provided. The last complete contact between the working surface of the upper die 32 and the blank 100 (and thus the end of the operation) may be for example between 180° and 210° position.

Figure 2G:
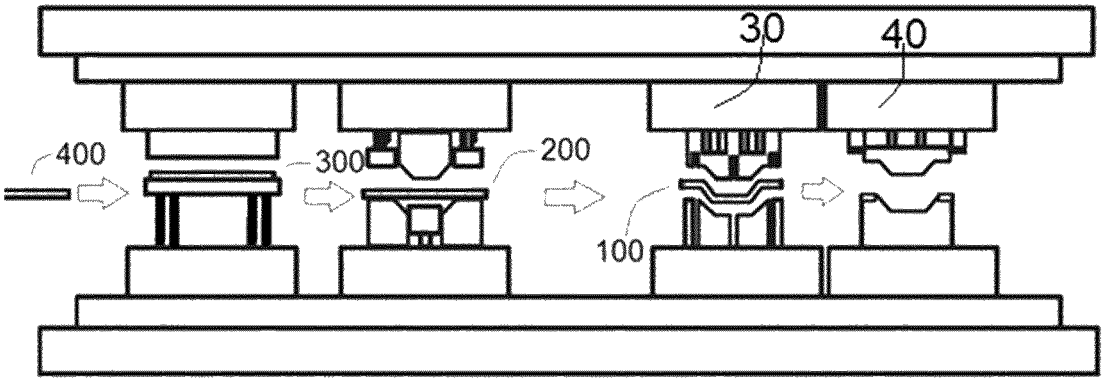
Figure 2H:
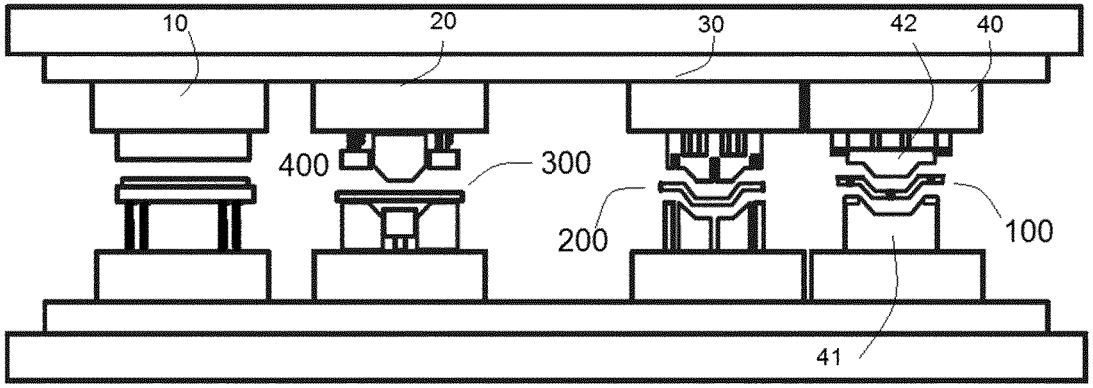
Figure 2I:
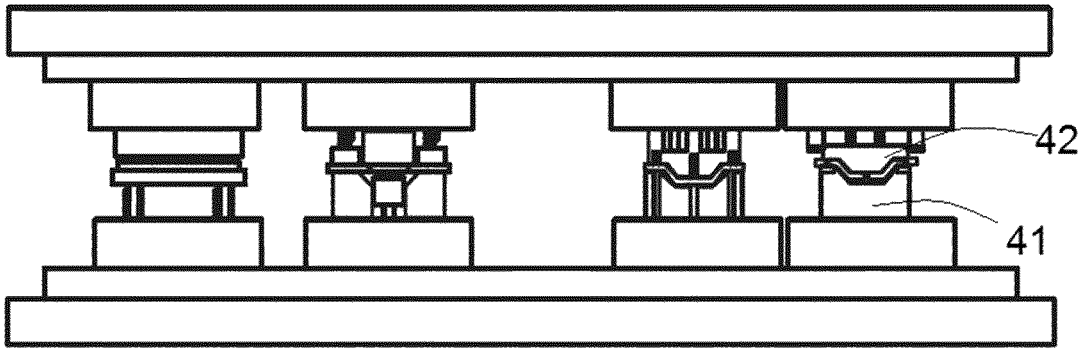

FIGS. 2*g*-2*h* schematically illustrate the next steps in which blank 100 is positioned in a second post operation tool, and yet a further blank 400 is positioned in the cooling tool.

In FIG. 2*g*, the blank 100 may be transferred from the first post-operation tool 30 to the second post-operation tool 40 e.g. piercing, trimming and calibration tool. The transferring may be performed by an automatic transfer device (not shown) e.g. a plurality of industrial robots or a conveyor. As previously commented, the blank 100 may leave the first post-operation tool 30 and it may be transferred at a temperature at or near 200° C.

While the press is in contact with the blank 100, a piercing operation or trimming operation and/or a calibration operation may be performed. Calibration may be performed to improve the tolerances of the blank.

In this case, distance between the upper die 42 and the lower die 41 may be adjusted using an adjusting device. The adjusting device may be controlled based on a sensor system (not shown) configured to detect the thickness of the blank 100. Following the example, the blank may be pressed by the upper 42 and lower 41 dies, thus a constant thickness of the blank may be achieved.

Once the operation of the second post-operation tool is finished, the blank 100 may be transferred left to cool to room temperature.

Once the open position (0° position) is reached by the press by applying the upwards movement, the blank 100 may be transferred and hardened at a room temperature. At the same time, the automatic transfer system may be operated to provide a new blank to the cooling tool 10, the blank 200 to the second post-operation tool 40, the blank 300 to the first post-operation tool 30 and the blank 400 to the press tool 20. As a result, all the tools may start their operations as previously commented, see FIG. 2*i*.

In some examples, depending on the shape of the blank 100, further drawing and other operations e.g. piercing and/or trimming may be provided. In further examples, the order of post-operations may be interchanged (e.g. first cutting, then calibrating or vice versa).

In other examples, the multi-step apparatus might only have two of the tools of the previous example. For example, the multi-step apparatus might have a cooling tool and a forming tool. The cooling and forming tool may be substantially similar to the example hereinbefore described. In another example, the multi-step apparatus might have a forming tool and a cutting tool. In yet another example, a cooling tool, a forming tool, and a post-operation tool.

In all these examples, the use of an UHSS steel substrate with an AlSi coating (rather than a Zn coating) means that the number of process steps might be reduced, since shot blasting or similar to remove zinc oxide can be avoided. This can lead to more efficiency and cost reduction.

A pre-cooling tool integrated in the multi-step apparatus means that temperature control can be improved and cycle times of the steps can be reduced.

For reasons of completeness, various aspects of the present disclosure are set out in the following numbered clauses:

Clause 1. A method for hot forming a structural component system in a multi-step apparatus comprising

- a lower body,
- a mobile upper body,
- a mechanism configured to provide upwards and downwards press progression of the mobile upper body with respect to the lower body, and
- a press tool configured to draw the blank, the press tool comprising:
  - upper and lower mating pressing dies, each pressing die comprising one or more working surfaces that in use face the blank, and
  - the upper pressing die is connected to the upper body and the lower pressing die is connected to the lower body, and
- an additional tool comprising
  - upper and lower dies comprising one or more working surfaces that in use face the blank, and
  - the lower die of the additional tool connected to the lower body and the upper die of the additional tool is connected to the upper body, the method comprising

- providing a blank made of an Ultra High Strength Steel (UHSS) coated with an aluminium-silicon coating;
- heating the blank to above an austenization temperature; and
- drawing the heated blank in the press tool and transferring the blank between the press tool and the additional tool.

Clause 2. A method according to clause 1, wherein the additional tool is a cooling tool arranged upstream from the forming tool, and the method comprising cooling down the complete heated blank.

Clause 3. A method according to clause 2, wherein the dies of the cooling tool comprise channels conducting cooling water.

Clause 4. A system according to clause 2, wherein the dies of the cooling tool comprise channels conducting air.

Clause 5. A method according to any of clauses 2-4, wherein the austenization temperature is an Ac3 temperature, and cooling down the complete heated blank comprises cooling down the blank to a temperature between 600-800° C., specifically between 650°-700° C.

Clause 6. A method according to clause 5, wherein the blank is cooled down at a rate between 50 and 300° C./s.

Clause 7. A method according to clause 5 or 6, wherein a temperature of the blank in the forming tool before forming is in a range of 550-650° C.

Clause 8. A method according to clause 1, wherein the additional tool is a heating tool arranged upstream from the forming tool, and heating the blank above the austenization temperature comprises heating the blank in a furnace to a first temperature, and heating the blank from the first temperature to a second temperature in the heating tool.

Clause 9. A method according to any of clauses 1-8, wherein the UHSS comprises in weight percentages 0.20-0.25% C; 0.75-1.5% Si and 1.50-2.50% Mn, preferably 0.21-0.25% C, 1.05-1.33% Si, 2.06-2.34% Mn.

Clause 10. A method according to clause 9, wherein the UHSS wherein the UHSS comprises approximately 0.22% C, 1.2% Si, 2.2% Mn.

Clause 11. A method according to clause 9 or 10, wherein the UHSS further comprises Mn, Al, Ti, B, P, S, N.

Clause 12. A method according to any of clauses 1-8, wherein the UHSS comprises in weight percentages 0.17-0.23% C, maximum 0.5% Si, maximum 2.5% Mn, maximum 0.05% Cr, and 0.002-0.005% B.

Clause 13. A method according to clause 12, wherein the UHSS further comprises Al, Ti, P, and Mo.

Clause 14. A method according to any of clauses 1-8, wherein the UHSS is an air hardenable UHSS.

Clause 15. A method according to any of clauses 1-8, wherein the UHSS comprises in weight percentages 0.20-0.5% C, preferably 0.30-0.40% C, 0.10-0.70% Si, 0.65-1.60% Mn and 0.001-0.005% B.

Clause 16. A method according to any of clauses claims 1-8, wherein the UHSS is a non air hardenable UHSS.

Clause 17. A method according to any of clauses 1-16, wherein the multi-step apparatus further comprises a first post operation tool downstream from the press tool, the first post operation tool comprising upper and lower first post operation dies comprising one or more working surfaces that in use face the blank, and the lower first post operation die being connected to the lower body and the upper first post operation die being connected to the upper body.

Clause 18. A method according to clause 17, wherein the first post operation tool comprises a temperature control system for controlling the temperature of the blank during the first post operation, the temperature control system optionally including thermocouples in the dies.

Clause 19. A method according to clause 18, wherein the dies of the first post-operation tool comprise channels conducting cooling water or cooling air.

Clause 20. A method according to clause 18 or 19, wherein the dies of the first post-operational tool comprises one or more heaters or channels conducting a hot liquid.

Clause 21. A method according to any of clauses 17-20, wherein the multi-step apparatus further comprises a second post operation tool downstream from the first post operation tool, the second post operation tool comprising upper and lower second post operation dies comprising one or more working surfaces that in use face the blank, and the lower second post operation die being connected to the lower body and the upper second post operation die being connected to the upper body.

Clause 22. A method according to clause 21, wherein the second post operation tool comprises a temperature control system for controlling the temperature of the blank during the first post operation, the temperature control system optionally including thermocouples in the dies.

Clause 23. A method according to clause 22, wherein the dies of the second post-operation tool comprise channels conducting cooling water or cooling air.

and/or one or more heaters or channels conducting a hot liquid.

Clause 24. A method according to any of clauses 1-23, wherein the dies of the press tool comprise channels conducting cooling water and/or channels conducting air.

Clause 25. A method according to any of clauses 1-24, wherein the blank is heated to an austenization temperature between 860° C. and 910° C.

Clause 26. A method according to any of clauses 1-25, further comprising cooling down the blank during forming.

Clause 27. A method according to clause 26, wherein the blank is cooled down during forming to a temperature between 320° C. and 280° C.

Clause 28. A method according to any of clauses 1-27, wherein the temperature of the blank when leaving the multi-step apparatus is below 200° C.

Clause 29. A use of an Ultra High Strength Steel (UHSS) having an aluminium-silicon coating in a hot forming process, wherein the hot forming process includes heating a blank made of the UHSS having an aluminium silicon coating to above an austenization temperature, and forming the heated blank in a multi-step apparatus, the multi-step apparatus comprising a cooling tool and a forming tool integrated in the multi-step apparatus, the cooling tool arranged upstream from the forming tool.

Clause 30. A use according to clause 29, wherein the UHSS is an air hardenable steel.

Clause 31. A use according to clause 29 or 30, wherein the UHSS comprises in weight percentages 0.21-0.25% C, 1.05-1.33% Si, 2.06-2.34% Mn.

Clause 32. A use according to clause 31, wherein the UHSS comprises approximately 0.22% C, 1.2% Si, 2.2% Mn.

Clause 33. A use according to clause 31 or 32, wherein the UHSS further comprises Mn, Al, Ti, B, P, S, N.

Clause 34. A use according to clause 29, wherein the UHSS is a non air hardenable steel.

Clause 35. A use according to clause 29 or 34, wherein the UHSS comprises in weight percentages 0.20-0.5% C, preferably 0.30-0.40% C, 0.10-0.70% Si, 0.65-1.60% Mn and 0.001-0.005% B.

Clause 36. A use according to any of clauses 29-35, wherein the austenization temperature is an Ac3 temperature, and wherein the complete heated blank cools down the blank to a temperature between 600-800° C., specifically between 650°-700° C. in the cooling tool.

Clause 37. A use according to clause 26, wherein a temperature of the blank in the forming tool before forming is in a range of 550-650° C.

Clause 38. A use of an Ultra High Strength Steel (UHSS) having an aluminium-silicon coating in a hot forming process, wherein the hot forming process includes heating a blank made of the UHSS having an aluminium silicon coating to above an austenization temperature, and forming the heated blank in a multi-step apparatus including multiple tools integrated in the multi-step apparatus, wherein the UHSS comprises in weight percentages 0.21-0.25% C, 1.05-1.33% Si, 2.06-2.34% Mn.

Clause 39. A use according to clause 38, wherein the UHSS wherein the UHSS comprises approximately 0.22% C, 1.2% Si, 2.2% Mn.

Clause 40. A use according to clause 38 or 39, wherein the UHSS further comprises Mn, Al, Ti, B, P, S, N.

Clause 41. A use of an Ultra High Strength Steel (UHSS) having an aluminium-silicon coating in a hot forming process, wherein the hot forming process includes heating a blank made of the UHSS having an aluminium silicon coating to above an austenization temperature, and forming the heated blank in a multi-step apparatus including multiple tools integrated in the multi-step apparatus, wherein the UHSS comprises in weight percentages 0.20-0.5% C, preferably 0.30-0.40% C, 0.10-0.70% Si, 0.65-1.60% Mn and 0.001-0.005% B.

Clause 42. A use according to any of clauses 38-41, wherein the multi-step apparatus comprises a forming tool and one or more post operation tools arranged downstream from the forming tool.

Clause 43. A use according to clause 42, wherein the multi-step apparatus comprises a cooling tool arranged upstream from the forming tool.

Clause 44. A use of an Ultra High Strength Steel (UHSS) having an aluminium-silicon coating in a hot forming process, wherein the hot forming process includes heating a blank made of the UHSS having an aluminium silicon coating to above an austenization temperature, and forming the heated blank in a multi-step apparatus, wherein the UHSS is an air hardenable steel.

Clause 45. A use of an Ultra High Strength Steel (UHSS) having an aluminium-silicon coating in a hot forming process, wherein the hot forming process includes heating a blank made of the UHSS having an aluminium silicon coating to above an austenization temperature, and forming the heated blank in a multi-step apparatus, wherein the UHSS is a non air hardenable steel.

Clause 46. A method for hot forming a structural component system comprising providing a blank made of an Ultra High Strength Steel (UHSS) coated with an aluminium-silicon coating;

heating the blank to above an austenization temperature;

cooling down the blank in a cooling tool;

transferring the blank from the cooling tool to a press tool; and drawing the blank in the press tool, wherein the cooling tool and the press tool are integrated in a multi-step apparatus.

Clause 47. A component obtainable by any of the methods or uses according to any of clauses 1-46.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow.

The invention claimed is:

1. A method for hot forming a structural component system in a multi-step apparatus, said multi-step apparatus comprising:

a lower body, a mobile upper body, a mechanism configured to provide upwards and downwards press progression of the mobile upper body with respect to the lower body, a press tool configured to draw a blank; and a cooling tool upstream from the press tool, wherein the press tool comprises:

upper and lower mating pressing dies, each pressing die comprising one or more working surfaces that in use face the blank, and the upper pressing die is connected to the upper body and the lower pressing die is connected to the lower body, wherein:

the cooling tool comprises upper and lower cooling dies comprising one or more working surfaces that in use face the blank, and the lower cooling die is connected to the lower body and the upper cooling die is connected to the upper body, the method comprising:

providing a blank made of an Ultra High Strength Steel (UHSS) coated with an aluminium-silicon coating;

heating the blank to above an austenization temperature, wherein the austenization temperature is an Ac3 temperature;

cooling the complete heated blank in the cooling tool, wherein cooling the complete heated blank comprises cooling down the blank at a rate above 50° C./s and below 200° C./s such that the cooled down blank leaves the cooling tool at a temperature between 600° C. and 800° C.; and drawing the blank in the press tool and transferring the blank between the cooling tool and the press tool, wherein a temperature of the blank in the press tool before drawing is in a range between 550° C. and 650° C.

2. The method according to claim 1, wherein the dies of the cooling tool comprise channels conducting cooling water.

3. The method according to claim 1, wherein the UHSS comprises in weight percentages 0.21-0.25% C, 1.05-1.33% Si, 2.06-2.34% Mn.

4. The method according to claim 1, wherein the UHSS comprises in weight percentages 0.17-0.23% C, maximum 0.5% Si, maximum 2.5% Mn, maximum 0.05% Cr, and 0.002-0.005% B.

5. The method according to claim 1, wherein the UHSS is an air hardenable UHSS.

6. The method according to claim 1, wherein the UHSS comprises in weight percentages 0.20-0.5% C, 0.10-0.70% Si, 0.65-1.60% Mn and 0.001-0.005% B.

7. The method according to claim 1, wherein the UHSS is a non air hardenable UHSS.

8. The method according to claim 1, wherein the multi-step apparatus further comprises a first post operation tool downstream from the press tool, the first post operation tool comprising upper and lower first post operation dies comprising one or more working surfaces that in use face the blank, and the lower first post operation die being connected to the lower body and the upper first post operation die being connected to the upper body.

9. The method according to claim 8, wherein the first post operation tool comprises a temperature control system for controlling the temperature of the blank during the first post operation.

10. The method according to claim 9, wherein the dies of the first post-operation tool comprise channels conducting cooling water or cooling air.

11. The method according to claim 9, wherein the dies of the first post operation tool comprises one or more heaters or channels conducting a hot liquid.

12. The method according to claim 1, wherein heating the blank comprises heating to a temperature between 860° C. and 910° C.

13. The method according to claim 1, further comprising cooling down the blank during drawing.

14. The method according to claim 13, wherein the blank is cooled down during drawing to a temperature between 320° C. and 280° C.

15. The method according to claim 1, wherein the blank is configured to leave the multi-step apparatus, and wherein the temperature of the blank when leaving the multi-step apparatus is below 200° C.

16. The method according to claim 1, wherein cooling down the complete heated blank in the cooling tool comprises cooling down the blank such that the cooled down blank leaves the cooling tool at a temperature between 650° C. and 700° C.

17. The method according to claim 6, wherein the UHSS comprises in weight percentages 0.3%-0.4% C.

18. The method according to claim 9, wherein the temperature control system includes thermocouples in the first post operation dies.

19. The method according to claim 8, wherein:

the multistep apparatus further comprises a second post operation tool downstream from the first post operational tool, the second post operation tool comprises upper and lower second post operation dies comprising one or more working surfaces that, in use, face the blank, and wherein the lower second post operation die is connected to the lower body and the upper second post operation die is connected to the upper body.

20. The method according to claim 1, wherein the dies of the press tool comprise at least one of channels conducting cooling water or channels conducting air.

* * * * *